US005916069A

United States Patent [19]

Wang et al.

[11] Patent Number: 5,916,069

[45] Date of Patent: Jun. 29, 1999

[54] ROWING EXERCISER WITH MAGNETIC RESISTANCE

[76] Inventors: Leao Wang; Peter Wu, both of No.1,Lane 154,Charng Long Rd., Taiping City,Taichung Hsien, Taiwan

[21] Appl. No.: 08/816,149

[22] Filed: Mar. 12, 1997

[51] Int. Cl.[6] ..... A63B 22/06

[52] U.S. Cl. ..... 482/72; 482/57; 482/903

[58] Field of Search ..... 482/903, 1–10, 482/57, 72

[56] References Cited

U.S. PATENT DOCUMENTS 4,798,378 1/1989 Jonas ..... 482/903
5,031,901 7/1991 Saarinen ..... 482/903
5,076,573 12/1991 Lo .
5,094,447 3/1992 Wang ..... 482/63
5,466,203 11/1995 Chew ..... 482/903

*Primary Examiner*—Jerome Donelly

[57] ABSTRACT

Resistance in a rowing exerciser may be adjusted by varying the distance between a magnet set and a magnetically conductive flywheel that is attached to a second wheel having a cord wound there around and connected to a handle which is pulled by a user. A spiral spring engaged with the second wheel causes retraction of the cord after it is extended by the pulling action.

5 Claims, 7 Drawing Sheets

ROWING EXERCISER WITH MAGNETIC RESISTANCE

BACKGROUND OF THE INVENTION

1. Field of the Invention

The invention relates to a rowing exerciser, and specifically to one that utilizes an adjustable magnet-controlled wheel mechanism which permits the user to adjust exercise resistance.

2. Description of the Prior Art

As shown in FIG. 9, in a conventional rowing exerciser the user sits on a slider 10 and uses both hands to pull a bar 11, bar 11 strains a cord 12 connected to it, cord 12 in turn extracts the shaft of a spring air-pressure cylinder 13 at its other end, and spring air-pressure cylinder 13 then generates appropriate resistance for exercise. When the user releases the strain, the spring reacts to put cord 12 and the bar 11 back to their original positions, so that the user can repeat the pulling exercise.

When the user would like to adjust the resistance for exercise, the valve on the spring air-pressure cylinder 13 must be turned. The resistance can be determined by the amount of fluid leakage. In other words, a large resistance requires less leakage, while a smaller resistance requires more leakage. However, the spring in the spring air-pressure cylinder 13 is apt to fatigue as a result of long term repeated stretching and reduces the exercise effects. At the same time, the spring air-pressure cylinder 13 is generally positioned under the exerciser, which causes inconvenience for adjustment.

Beside those rowing exercisers that utilize a spring air-pressure cylinder 13 for exercise resistance and cord restoration, there are ones based on an air-resistance or a user-weight mechanism design. The air-resistance fan mechanism 14 shown in FIG. 10 generates tremendous noise. Moreover, the user-weight mechanism 15 shown in FIG. 11 utilizes the weight of the user as the source of resistance, which can overburden the user.

SUMMARY OF THE INVENTION

Therefore, to overcome the shortcomings associated with the above-mentioned rowing exercisers in usage and design, the present invention provides an exerciser which is based on a magnet set and shear resistance from a magnetically conductive flywheel. This enables a wheel coaxial with the flywheel to generate resistance for effective exercise. Furthermore, by turning an adjusting nut, the distance between the magnet set and the flywheel can be easily changed to vary magnetic resistance. Thus, the advantages of easy adjustment of resistance and elimination of noise are realized.

DETAILED DESCRIPTION OF THE PREFERRED EMBODIMENT

Figure 1:
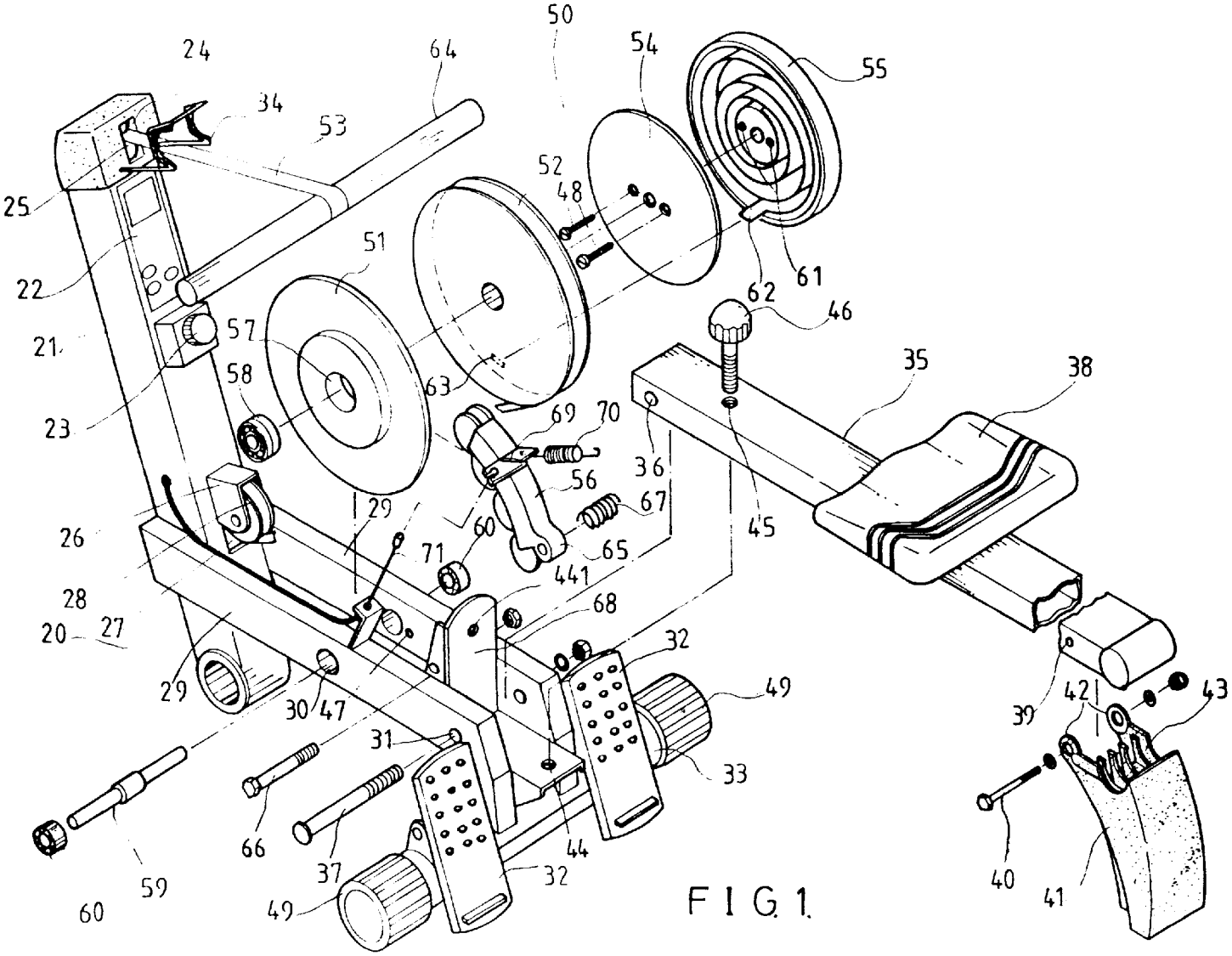
FIG. 1 is an exploded perspective view of a rowing exerciser according to the invention.
Figures 2, 3:
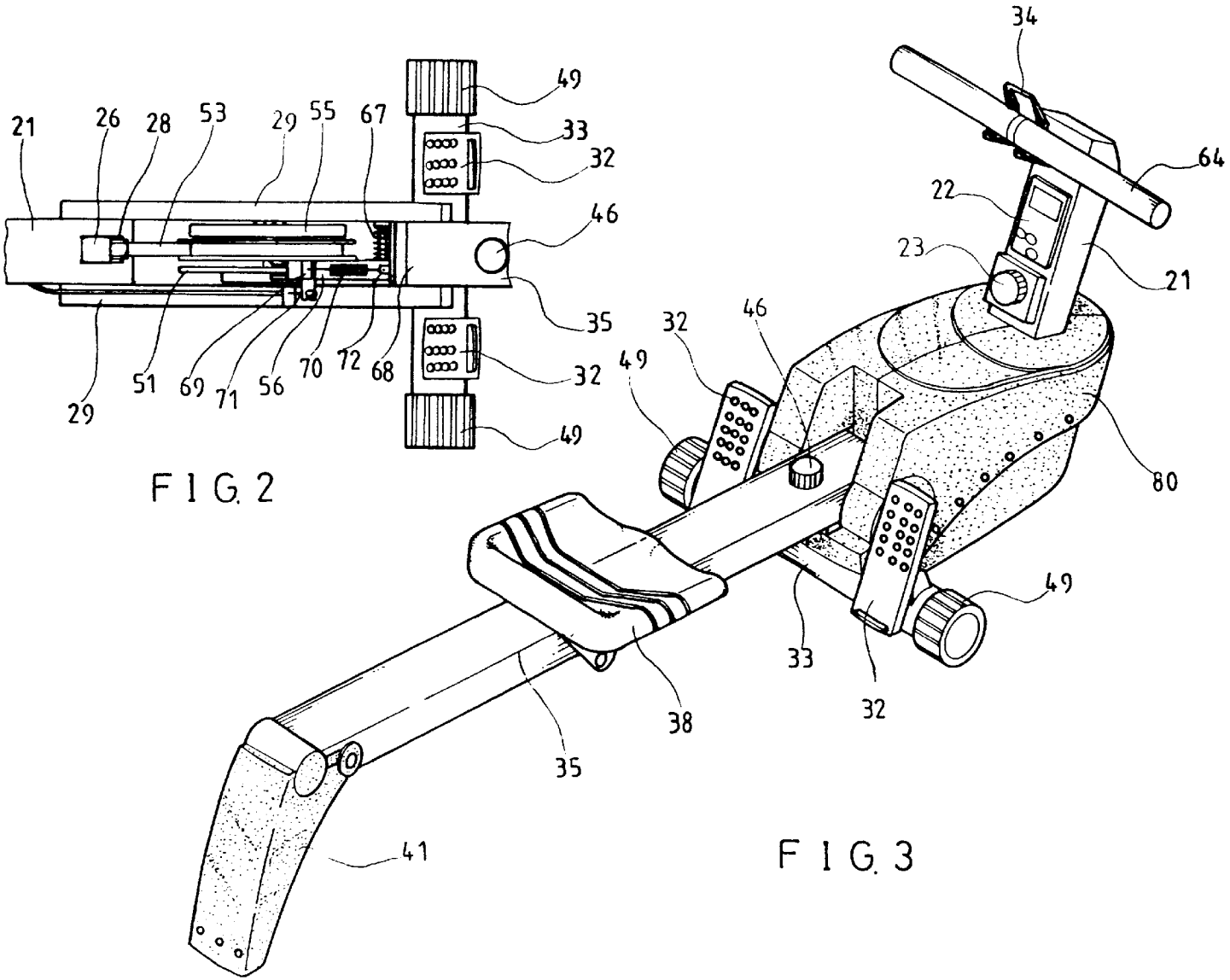
FIG. 2 is a top view of the exerciser.
FIG. 3 is a perspective view of the exerciser.

As shown in FIGS. 1 and 2, the rowing exerciser includes a front mainframe 20 having a hollow tilt beam 21. On tilt beam 21 are provided a pulling bar supporter 34, a counter-timer clock 22, an adjusting nut 23, and a first recess 24. Inside recess 24 are two pressing wheels 25 located at the top and the bottom of recess 24. Adjacent the bottom of front mainframe 20 are a mount 26 and a second recess 27 for the installation of a leading wheel 28. Under leading wheel 28, on both sides of front mainframe 20 and tilt beam 21, there are two side bars 29. The side bars 29 have one pair of axle holes 30 and one pair of connections holes 31, for the installation of an adjustable magnetically controlled wheel mechanism 50 and a slider bar 35, respectively. At the rear ends of side bars 29, are a ground bar 33 with two foot plates 32. At each end of bar 33 is a transport wheel 39.

Slider bar 35 is provided with holes 36 at both sides of its front end for receiving a bolt 37 which connects to side bars 29 of front mainframe 20 at their connection holes 31.

On top of bar 35 is a seat 38 that slides. At the bottom of bar 35 and on each of two sides thereof, a hole 39 is provided together with a bolt 40 for connection with a back support plate 41. Plate 41 is arc-shaped and has a connecting hinge 42 at its top. Hinge 42 is of a half-circle shape and has a concave part 43 to match the shape of the back end of slider 35, thus permitting plate 41 to tilt up. Consequently, plate 41 and grounding bar 33 form the grounding points which support the exerciser, as seen in FIG. 4.

An adjustable magnet-controlled wheel mechanism 50 is installed between side bars 29 of front mainframe 20. Mechanism 50 consists of a magnetically-conductive flywheel 51, a drive wheel 52, a cord 53 wound around wheel 52, a spiral spring cover 54, a spiral spring set 55, and a magnet set 56. Axial hole 57 of flywheel 51 is installed with a unidirectional bearing 58 which confines flywheel 51 to rotate in only one direction. An axle 59, together with two stopping bearings 60, fixes flywheel 51, drive wheel 52 and spiral spring set 55 between axle holes 30. Cover 54 is secured to spiral spring set 55 by two screws 48 through holes 61 of set 55 and holes 47 in side bars 29. Active end 62 of spring set 55 is fixed in notch 63 of drive wheel 52. After being wound for several rounds around wheel 52, an outer end of cord 53 goes under leading wheel 28 and inside tilt beam 21 of front mainframe 20, and then exits out between pressing wheels 25. The outer end of cord 53 is connected to a pulling bar 64. Under magnet set 56 are a hinge 65, a bolt 66 and a spring 67 for securing set 56 to positioning board 68 between side bars 29. Near the top of set 56 is a connecting unit 69 to hook one end of a spring 70 and an adjusting rope 71. The other end of spring 70 is hooked on a tab 72 of positioning board 68.

Figure 4:
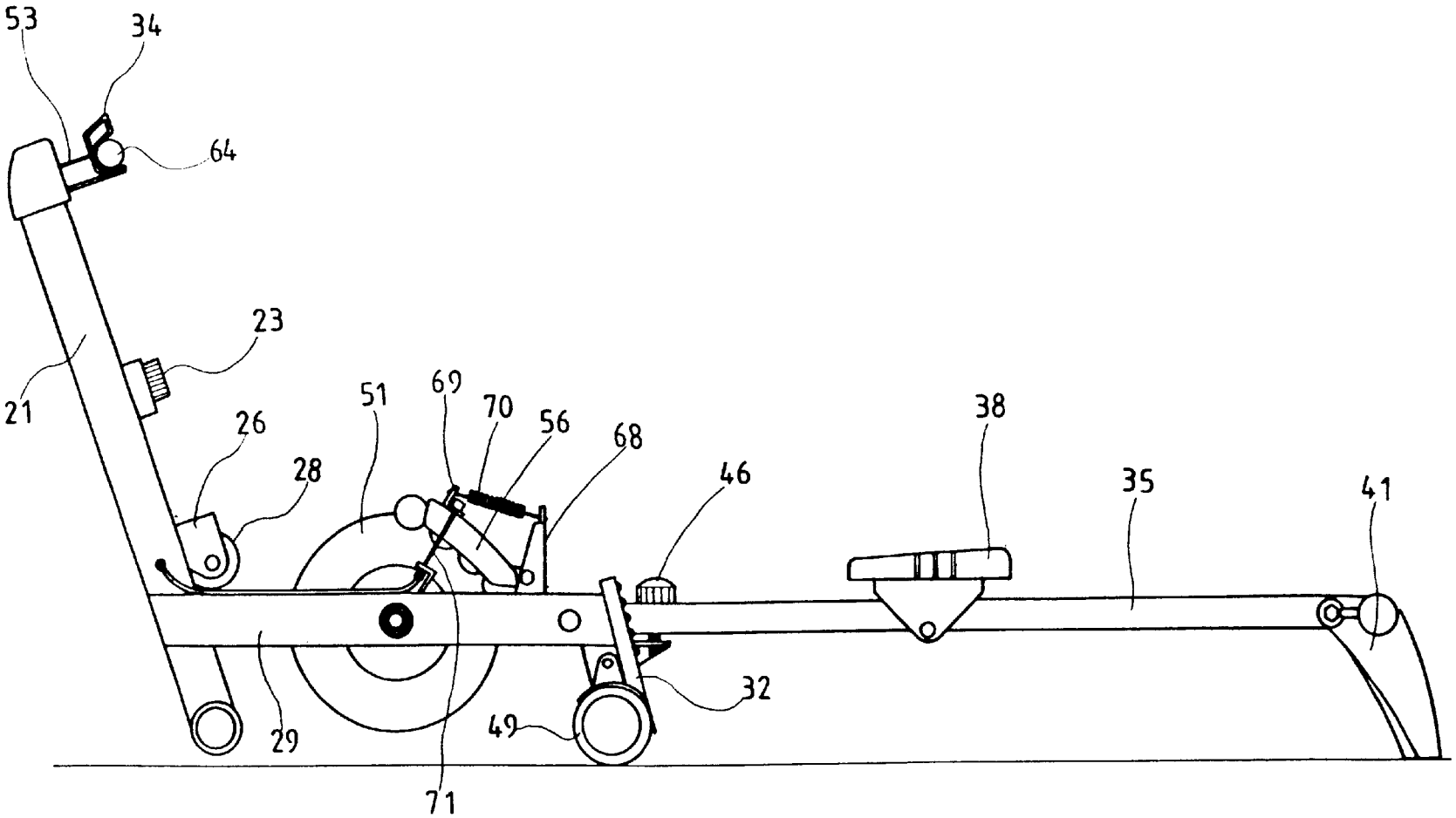
FIG. 4 is a side view of the exerciser.

As shown in FIGS. 2 and 4, when the assembly of the adjustable magnet-controlled wheel mechanism 50 is assembled, magnet set 56 is positioned at the edge of flywheel 51 and generates the desirable shear resistance. Therefore, as the user turns adjusting nut 23, the actions of adjusting rope 71 and spring 70 move magnet set 56 towards or away from the edge of flywheel 51, and consequently the resistance is easily adjusted. When the assembly of the mechanism 50 is completed, a protection cover 80 is applied on both sides of front mainframe 20, as shown in FIG. 3.

Figure 6:
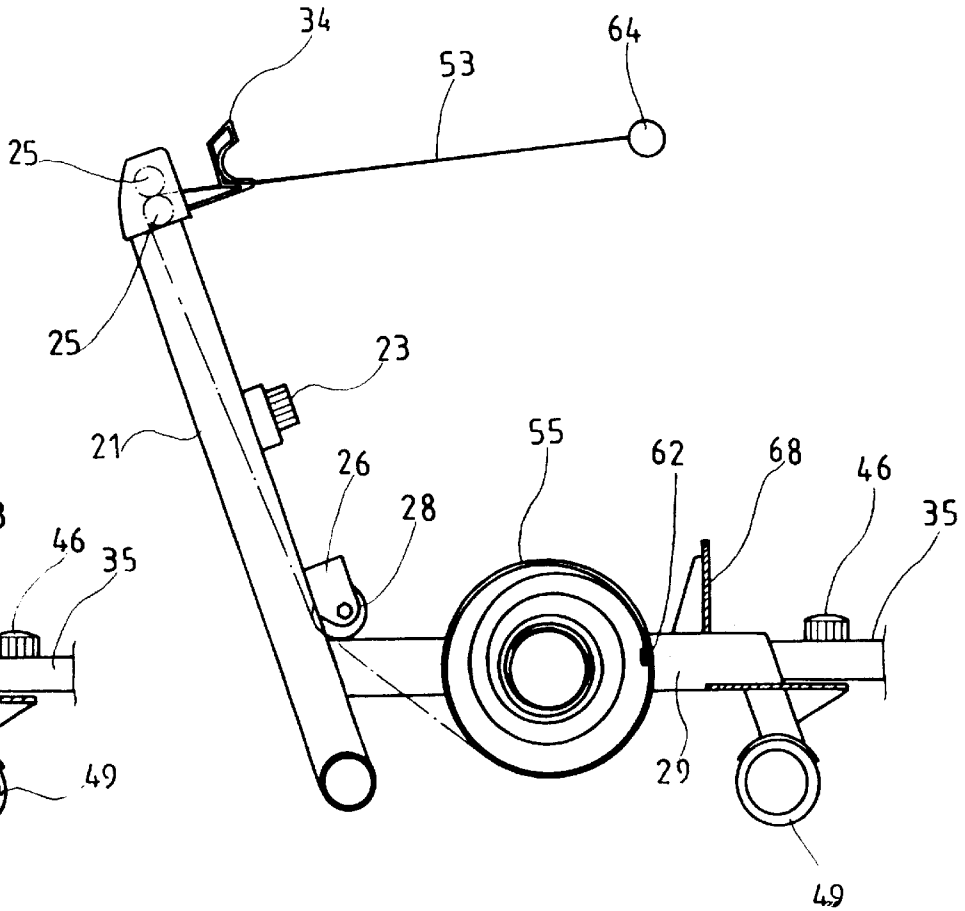
FIG. 6 is a partial side view showing the cord in an extended position.
Figure 5:
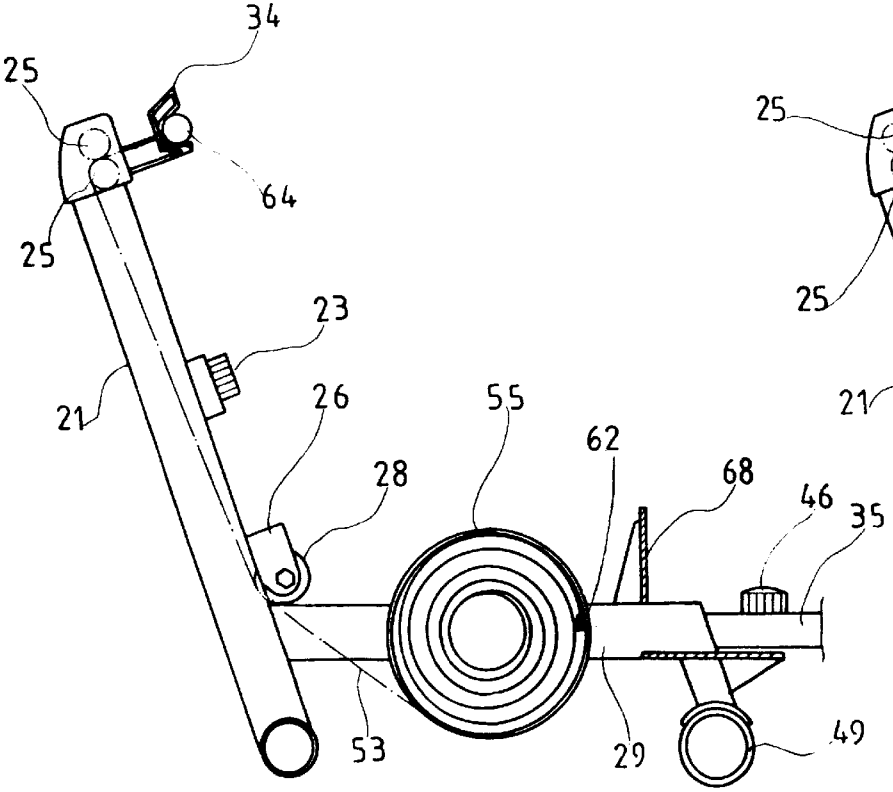
FIG. 5 is a partial side view of the exerciser showing the cord in a retracted position.

In terms of the way cord 53 is driven, when the user pulls pulling bar 64 and cord 53, drive wheel 52 will subsequently rotate and release cord 53 that is initially wound thereon. The rotation of wheel 52 will cause flywheel 51 to rotate synchronously through axle 59. However, because shear resistance from magnet set 56 acts on flywheel 51 and subsequently on drive wheel 52, the user will feel an expected resistance when pulling cord 53 and experience the results of exercise. As seen in FIG. 6, because active end 62 of spiral spring set 55 has been fixed in notch 63 of wheel 52 and rotated, the spiral spring in set 55 is wound tightly. Since spiral spring set 55 is fixed, only its active end 62 moves with the wheel 52. Then, as shown in FIG. 5, when the user releases cord 53, the reaction of the spiral spring set 55 and active end 62 will counter-rotate wheel 52, and subsequently retract cord 53 and pulling bar 64 for repetitive exercise. Because there is one unidirectional bearing 58 installed at axial hole 57 of flywheel 51, wheel 51 will not counter-rotate with wheel 52.

Figure 7:
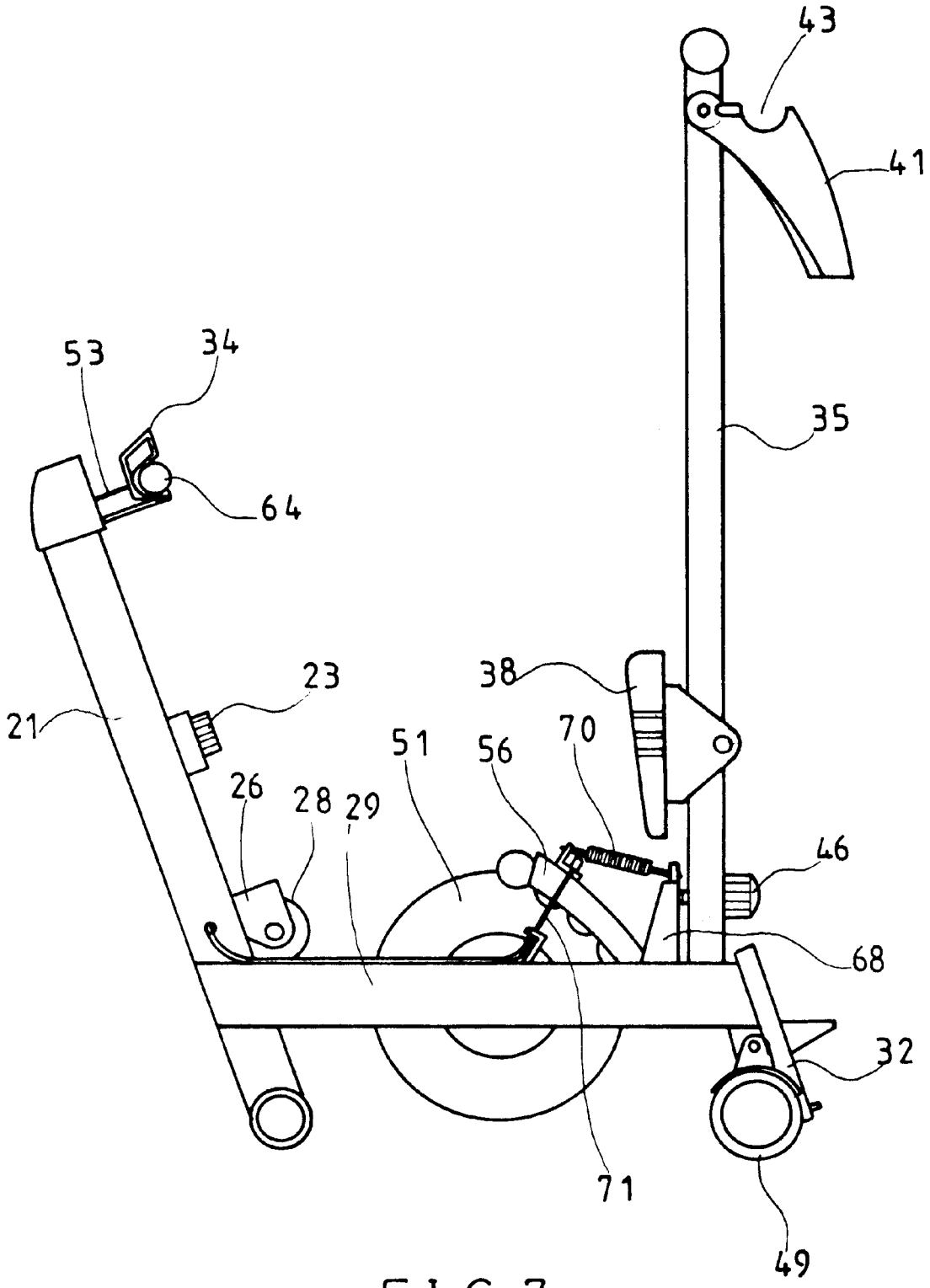
FIG. 7 is a side view showing the exerciser in a folded condition.
Figure 8:
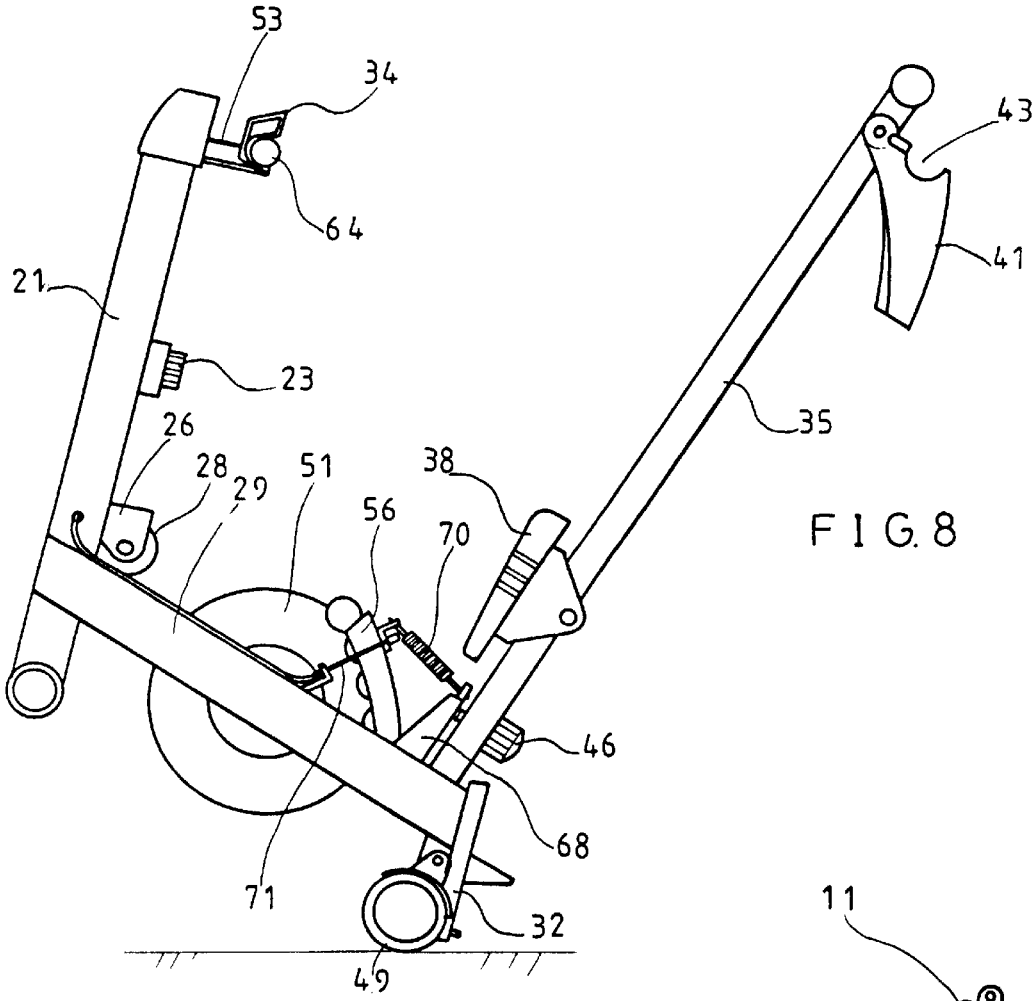
FIG. 8 is a side view showing the transporting of the exerciser shown in FIG. 7.
Figure 9:
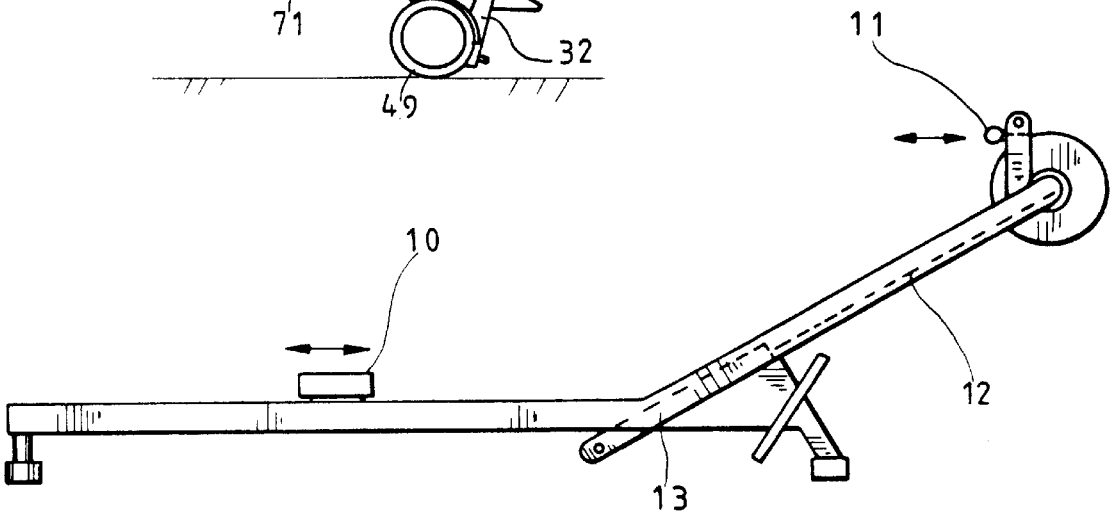
FIG. 9 PRIOR ART
FIG. 9 is a side view showing a first conventional rowing exerciser.
Figure 10:
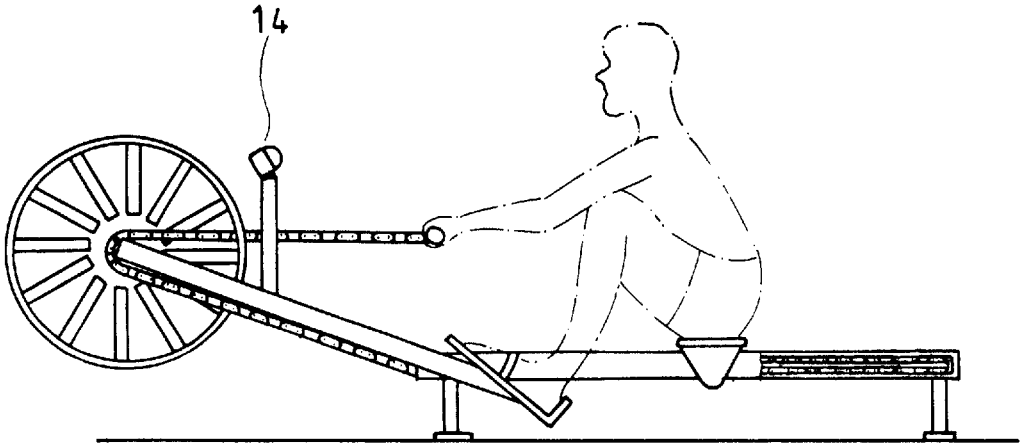
FIG. 10 PRIOR ART
FIG. 10 is a side view showing a second conventional rowing exerciser.
Figure 11:
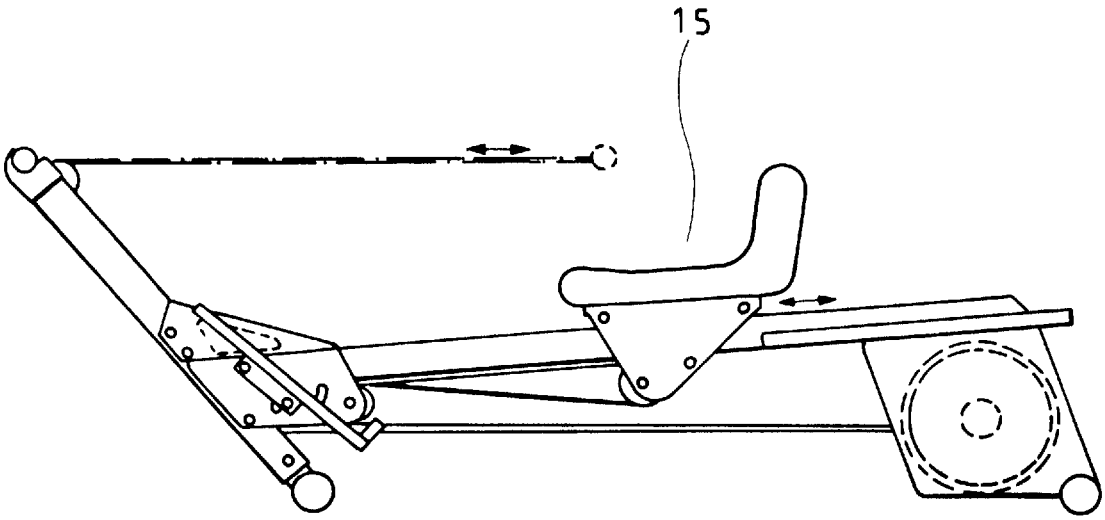
FIG. 11 PRIOR ART
FIG. 11 is a side view showing a third conventional rowing exerciser.

As seen in FIG. 7, slider bar 35 is only attached at connecting holes 31 of both side bars 29 of front mainframe 20. A bolt 46 extends through a hole 45 and engages a screw hole 44 of mainframe 20 to avoid rocking the exerciser during use. To pack the exerciser, the user takes off bolt 46, tilt slider bar 35 up straight, then fastens bolt 46 through hole 45 from the opposite side of bar 35 to engage screw hole 441 on positioning board 68, thus saving space. Finally, as shown in FIG. 8, when it is desired to move the exerciser, the user inclines the exerciser and uses wheels 49 to move the exerciser around.

We claim:

1. A rowing exerciser with magnetic resistance comprising:

a) a mainframe including a pair of side bars, a front end and a rear end, the rear end further including a pair of foot plates and wheel means for engaging a support surface and transporting the exerciser;

b) a tilt beam extending from the front end, the tilt beam including an upper portion and a lower portion, a pressing wheel means disposed at the upper portion and a leading wheel means disposed at the lower portion;

c) a slider bar including a front end and a rear end, the front end being pivotally connected to the rear end of the mainframe, a support plate pivotally mounted to the rear end of the bar for engaging a support surface, and a seat slidably mounted on the bar;

d) a magnet controlled wheel mechanism supported on the mainframe, the mechanism including a magnetically conductive flywheel, a drive wheel, the flywheel and drive wheel being coaxially mounted for synchronous rotation with each other, a unidirectional bearing means restricting the flywheel to one direction of rotation, a spiral spring having an active end secured to the drive wheel, and a magnet set position adjacent the periphery of the flywheel for imparting shear resistance thereto;

e) a pull cord wound around the drum wheel and including an outer end extending through the leading wheel means and pressing wheel means of the tilt beam, and a pulling handle secured to the outer end of the cord; and, f) wherein when a user sitting on the seat of the slider bar pulls the pulling handle to extend the cord, the drive and flywheels rotate synchronously in one direction and under shear resistance imparted by the magnet set, and the spiral spring is caused to be tightly wound, whereupon release of the cord by the user causes only the drive wheel to rotate in an opposite direction under the action of the spiral spring to retract the cord and permit same to be rewound on the drive wheel.

2. The exerciser of claim 1 wherein the adjustment means includes a knob mounted on the tilt beam, a rope connecting the knob to the magnet set, and a spring for imparting a bias to the magnet set.

3. The exerciser of claim 1 further including a counter-timer clock mounted on the tilt beam.

4. The exerciser of claim 1 wherein the tilt beam further includes an upper recess, the pressing wheel means includes a pair of opposed wheels disposed within the upper recess, a supporter mounted adjacent the upper recess for supporting the pulling handle, a lower recess, the leading wheel means includes a mount and a wheel secured at the lower recess.

5. The exerciser of claim 1 further including a detachable bolt for selectively securing the slider bar in either a horizontal position of use or an inclined position for transport of the exerciser.

* * * * *